US007393314B2

(12) United States Patent
Burger et al.

(10) Patent No.: US 7,393,314 B2
(45) Date of Patent: Jul. 1, 2008

(54) FOLDING FORMER FOR A PRESS

(75) Inventors: Rainer Burger, Augsburg (DE); Klaus Theilacker, Friedberg-Rederzhausen (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 11/351,612

(22) Filed: Feb. 9, 2006

(65) Prior Publication Data

US 2006/0178251 A1 Aug. 10, 2006

(30) Foreign Application Priority Data

Feb. 10, 2005 (DE) ..... 10 2005 006 066

(51) Int. Cl.
*B31B 1/26* (2006.01)

(52) U.S. Cl. ..... 493/405; 493/408; 493/414; 493/397

(58) Field of Classification Search ..... 493/405, 493/408, 397, 400, 414, 356, 254
See application file for complete search history.

(56) References Cited

U.S. PATENT DOCUMENTS

| | | | | | |
|---|---|---|---|---|---|
| 2,107,462 | A | * | 2/1938 | Wood | 270/37 |
| 3,544,107 | A | * | 12/1970 | Blomberg | 493/439 |
| 3,834,689 | A | * | 9/1974 | Lee et al. | 270/41 |
| 4,706,862 | A | * | 11/1987 | Theilacker | 226/92 |
| 5,016,863 | A | | 5/1991 | Birkmair | |

FOREIGN PATENT DOCUMENTS

| | | |
|---|---|---|
| DE | 20 24 648 | 12/1970 |
| DE | 34 16 501 | 12/1984 |
| DE | 39 13 112 | 10/1990 |

* cited by examiner

*Primary Examiner*—Sameh H. Tawfik
(74) *Attorney, Agent, or Firm*—Cohen Pontani Lieberman & Pavane LLP

(57) ABSTRACT

A folding former of a folder for a web-fed newspaper press has a former nose and a pivot point or pivot axis, the folding former being pivotable about the pivot point or the pivot axis. A former inclination angle is changed by pivoting the folding former to horizontally displace the former nose. A former spread angle is also changed as a function of the former inclination angle. To align the outer edges of sections to be folded in the folding former, the former inclination angle and the former spread angle are set as a function of the number of pages in the sections to be folded.

12 Claims, 1 Drawing Sheet

FOLDING FORMER FOR A PRESS

BACKGROUND OF THE INVENTION

The present invention relates to a folding former for a web-fed rotary newspaper press, the folding former including a former nose and a pivot point or a pivot axis, the folding former being pivotable about the pivot point or the pivot axis to horizontally displace the former nose which changes a former inclination angle (β), a former spread angle (γ) being changeable as a function of the former inclination angle (β).

The present invention also relates to a method for producing a printed product, such as a newspaper, having a plurality of sections, each section being provided with a longitudinal fold in a different folding former.

Folders of presses are used to form folds on printed printing materials. In prior art devices, a web-like printing material is first led through what is known as a folding former to form a longitudinal fold on the web-like and not yet severed printing material. Starting from the folding former, the web-like printing material is transported over a plurality of pull rolls in the direction of a cutting knife cylinder and a folding blade cylinder interacting with the cutting knife cylinder, copies being divided off from the web like printing material on the cutting knife cylinder and being moved in the direction of a folding jaw cylinder with the aid of the folding blade cylinder. The copy divided off from the web-like printing material on the cutting knife cylinder, which copy is moved in the direction of the folding jaw cylinder by the folding blade cylinder, is transferred from the folding blade cylinder to the folding jaw cylinder, forming a cross fold. The present invention relates to folding formers for the formation of the longitudinal folds on web-like and not yet severed printing material.

U.S. Pat. No. 5,016,863 discloses a folding former of a web-fed rotary press having two former halves. The folding former has a folder nose and a centre of gravity, it being possible for the folding former to be pivoted about the centre, of gravity, changing a former inclination angle, in order to displace the former nose horizontally forwards and/or backwards. U.S. Pat. No. 5,016,863 also discloses the practice of changing the former flank angle of the two former halves, depending on the change in the former inclination angle. The sum of the two former flank angles determines what is known as the former spread angle of the folding former.

During the production of printed products, in particular newspapers, having a plurality of sections, it is usual for sections of different thicknesses to be provided with appropriate longitudinal folds simultaneously on a plurality of folding formers. If a plurality of sections of different thickness are combined to font a printed product, for example a newspaper, then the position of an outer edge of the respective section is determined by the thickness of the same, the outer edges of thicker sections lying further forward than the outer edges of thinner sections. For visual reasons, however, it is desirable to bring the outer edges of all the sections into the same position in the finished product. Only then is there a visually ideally folded printed copy. Until now, the prior art has disclosed no folding formers which take account of this phenomenon.

SUMMARY OF THE INVENTION

An object of the present invention is to provide a novel type of folding former for a folder of a press which overcomes the problems of the prior art.

The object is met by a folding former for a folder of a press having a former nose and a pivot point or a pivot axis, the folding former being pivotable about the pivot point or the pivot axis which horizontally diplaces the former nose changing a former inclination angle (β), a former spread angle (γ) being changed as a function of the former inclination angle (β). According to the invention, the former inclination angle and the former spread angle are set as a function of the number of pages in the sections to be folded in order to align the outer edges of sections to be folded in the folding former.

To align the outer edges of sections to be folded in a folding former, it is proposed to adjust the former inclination angle and the folder spread angle as a function of the sections to be folded in the respective folding former, specifically as a function of the deviation of the number of pages of the section to be folded in the folding former from a reference section with a reference number of pages. This reference number of pages can also be zero. In this way, for the first time a folding former is purposed with which a visually correctly folded printed product which has sections of different thickness can be produced.

According to one embodiment, the former flank angles are adjusted asymmetrically by a correction angle to form a fold having a larger front side than rear side.

According to a further embodiment, the former flank angles can be adjusted by a correction angle in order to reduce web tensions that occur.

The object of the invention is also met by a method for producing a printed product having a plurality of sections, each section being provided with a longitudinal fold in a different folding former, wherein the former inclination angle (β) and the former spread angle (γ) of the folding formers are set as a function of the number of pages of the sections to be folded in each case to align the outer edges of sections to be folded in the folding formers.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
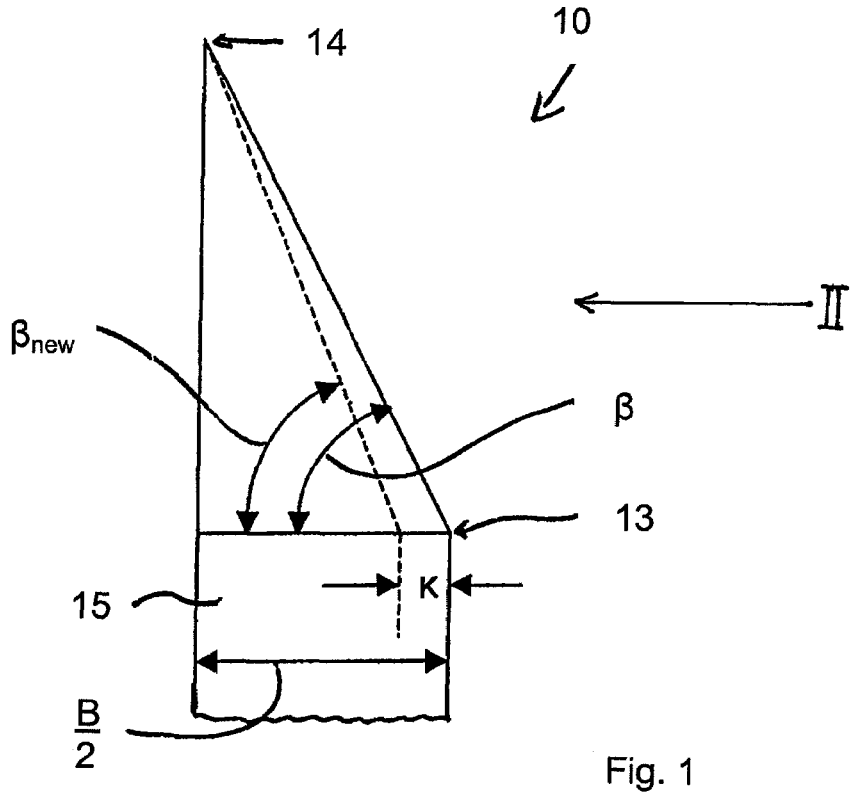
FIG. 1 is a schematic side view of a folding former according to an embodiment of the present invention in side view.
Figure 2:
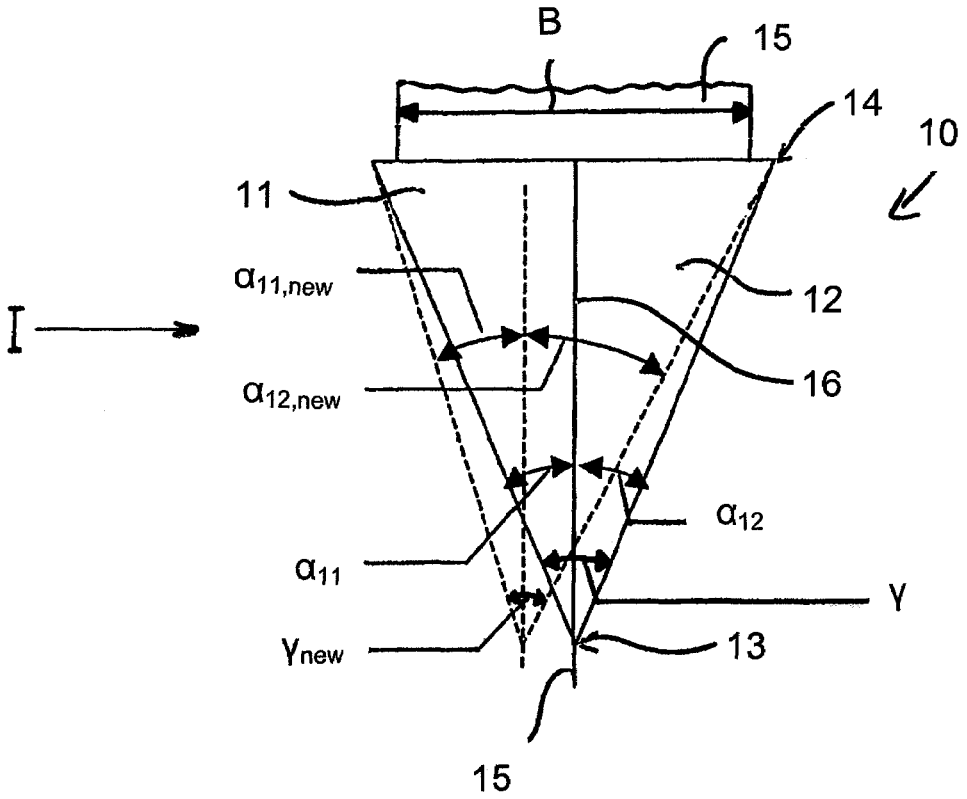
FIG. 2 is a schematic front view of the folding former of FIG. 1.

FIGS. 1 and 2 show, in highly schematic form, a folding former 10 comprising two former halves 11 and 12, the folding former 10 having a former nose 13 and a pivot point or a pivot axis 14. As can be gathered from FIG. 2, a web-like printing material 15 having a width B is introduced from above into the folding former 10 and led out of the same in the region of the former nose 13. The printing material 15 led out of the folding former 10 in the region of the former nose 13 has a width B/2 following the formation of a longitudinal fold in the folding former 10 according to FIG. 1. The position of the former nose 13 relative to the printing material 15 to be folded can be defined by a former inclination angle β (see FIG. 1) and a former spread angle γ (see FIG. 2). The former spread angle γ corresponds to the sum of the former flank angles $\alpha_{11}$ and $\alpha_{12}$ of the two former halves 11, 12 with respect to a vertical line 16.

In the following, it will be assumed that the folding former 10 of FIGS. 1 and 2 is set with respect to the former inclination angle β and the former spread angle γ and therefore the former flank angles α11, α12 to a reference section to be folded having a reference number of pages. This reference number of pages can also be zero. In order to align the outer edges of real sections to be folded in the folding former, the former inclination angle β and the former spread angle γ can now be set as a function of the real number of pages of the section to be folded. Depending on a deviation of the real number of pages of the section to be folded in the folding former from the reference number of pages of the reference section, the former inclination angle β and the former spread angle γ can be set by using the following equations:

$$K = \Delta S * \frac{k_1}{\sin(\beta)}$$

$$\beta_{new} = \beta + \arctan\left(\frac{K}{k_2}\right)$$

$$\gamma_{new} = 2 * \arctan(\cos(\beta_{new}))$$

where S is the deviation of the real number of pages of the section to be folded in the folding former from the reference number of pages of the reference section, $k_1$ is a constant depending on the layer thickness or printing material web thickness of the section to be folded, $k_2$ is a constant depending on the distance between former nose and pivot point or pivot axis, and $\beta_{new}$ and $\gamma_{new}$ are the angles depending on the real number of pages of the section to be folded in the folding former, namely the former inclination angle and former spread angle of the folding former.

By using the above relationships, it is possible to bring the position of the outer edges of sections of different thicknesses combined in a printed product into coincidence, so that there is a visually correctly folded printed product such as, for example, a newspaper. The values $\beta_{new}$ and $\gamma_{new}$ of the former inclination angle and former spread angle are calculated on the basis of the differential number of pages S between the section to be folded and the reference section. If the real section to be folded has a higher number of pages as compared with the reference section, for example, then according to FIG. 1 the former nose 13 is displaced by the amount K, by which means the former inclination angle $\beta_{new}$ is enlarged with respect to the former inclination angle β applying to the reference section, the former spread angle $\gamma_{new}$ is reduced. On the other hand, if the real section to be folded has a lower number of pages as compared with the reference section, the former inclination angle $\beta_{new}$ is reduced with respect to the former inclination angle β applying to the reference section, the former spread angle γ is enlarged.

Under the assumption that the former flank angles $\alpha_{11}$ and $\alpha_{12}$ and of the two former halves 11, 12 are equal, the former flank angles can be calculated by using the following two equations:

$$\gamma_{new} = \alpha_{11,new} + \alpha_{12,new}$$

$$\alpha_{11,new} = \alpha_{12,new} = \frac{\gamma_{new}}{2}$$

According to an advantageous development of the invention, in order to form a fold with a larger front side than rear side, the former halves 11, 12 can be set asymmetrically, in order in this way to be able to cover incorrectly folded layers. For this purpose, the former flank angles $\alpha_{11}$, $\alpha_{12}$ of the two former halves 11, 12 are set asymmetrically by a correction angle $\delta_1$, taking account of the two following equations:

$$\alpha_{11,new} = \frac{\gamma_{new}}{2} - \delta_1$$

$$\alpha_{12,new} = \frac{\gamma_{new}}{2} + \delta_1$$

Such an asymmetrical adjustment of the former flank angles $\alpha_{11}$ and $\alpha_{12}$ in order to provide a larger front side than rear side on a folded section is illustrated in FIG. 2 by using dashed lines. In the dashed lines, the former flank angle $\alpha_{11}$ is reduced and the former flank angle $\alpha_{12}$ is enlarged.

The correction angle $\delta_1$ for the asymmetrical or unsymmetrical setting of the former flank angles $\alpha_{11}$ and $\alpha_{12}$ is at most 2° and preferably lies in a range between 0.1° and 1°.

During the setting according to the present invention of former inclination angle and former spread angle and therefore of the former flank angles, it is possible for undesired web tensions to be established, which have a detrimental effect on the folding quality as a result of the formation of undesired creases. In order to reduce the web tensions, according to a further advantageous development of the present invention, the former flank angles $\alpha_{11}$, $\alpha_{12}$ are symmetrically adjusted in the event of disadvantageous web tensions by a correction value $\delta_2$, specifically by using the following equation:

$$\alpha_{11,new} = \alpha_{12,new} = \frac{\gamma_{new}}{2} + \delta_2$$

The correction angle $\delta_2$ for the former flank angles $\alpha_{11}$ and $\alpha_{12}$ for reducing web tensions preferably lies in a range between −1° and +1°, preferably in a range between −0.5° and +0.5°. In order to reduce the web tensions, therefore, the former flank angles $\alpha_{11}$ and $\alpha_{12}$ are enlarged or reduced, specifically until creases caused by web tensions disappear.

With the folding formers that can be adjusted according to the invention, it is accordingly possible for printed products, specifically newspapers, having sections of different thickness to be folded ideally. Each section is provided with a longitudinal fold on a separate folding former, it being possible for each of the folding formers, as described above, to be set and adjusted as a function of the number of pages of the section to be folded on the folding former.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated b, the scope of the claims appended hereto.

What is claimed is:

1. A folding former of a folder for folding a section of a printed product in printing press, the section having a number of pages, said folding former comprising a former nose arranged at a bottom end of said folding former and defining a former inclination angle (β) and a former spread angle (γ), said folding former being pivotably arranged for pivoting about a pivot point or a pivot axis for displacing the former nose horizontally and thereby changing the former inclination angle (β), the former spread angle (γ) being changable as a function of the former inclination angle (β), wherein the former inclination angle (β) and the former spread angle (γ) are set as a function of the number of pages in the section to be folded, whereby outer edges of the section to be folded in the folding former are aligned with other sections of the printed product, the former inclination angle (β) and the former spread angle (γ) being set according to the following equations:

$$K = \Delta S * \frac{k_1}{\sin(\beta)};$$

$$\beta_{new} = \beta + \arctan\left(\frac{K}{k_2}\right); \text{ and}$$

$$\gamma_{new} = 2 * \arctan(\cos(\beta_{new})).$$

where β is the former inclination angle of of the folding former when the folding former is set at a reference position for a reference section having a reference number of pages, γ is the former spread angle of the folding former when the folding former is set at the reference position, S is the deviation of the number of pages of the section to be folded in the folding former from the reference number of pages of the reference section, $k_1$ is a constant depending on the layer thickness of the section to be folded, $k_2$ is a constant depending on the distance between former nose and pivot point or pivot axis, K is the amount that the former nose is displaced during adjustment of the former from the reference position to the a position to be used for the section to be folded, $\beta_{new}$ is the former inclination angle of the folding former at the position of the folding former to be used for the section to be folded, and $\gamma_{new}$ is the former spread angle at the position of the folding former to be used for the section to be folded.

2. The folding former of claim 1, wherein former halves of said folding former are inclined with respect to a vertical line extending between said former nose and an upper end of said folding former by a former flank angle ($\alpha_{11}$, $\alpha_{12}$) defining a new former spread angle according to the following equation:

$$\gamma_{new} = \alpha_{11,new} + {}_{12,new},$$

where $\alpha_{11,\ new}$ is a flank angle of one of the flanks of the folding former when the folding former is at the position of the folding former to be used for the section to be folded, and $\alpha_{12,\ new}$ is a flank angle of the other of the flanks of the folding former when the folding former is at the position of the folding former to be used for the section to be folded.

3. The folding former of claim 2, wherein the former flank angles ($\alpha_{11}$, $\alpha_{12}$) are defined according to the following equation:

$$\alpha_{11,new} = \alpha_{12,new} = \frac{\gamma_{new}}{2}.$$

4. The folding former of claim 2, wherein the former flank angles ($\alpha_{11}$, $\alpha_{12}$) are adjusted asymmetrically by a correction angle $\delta_1$ to form a fold having a larger front side than rear side.

5. The folding former of claim 4, wherein the former flank angles ($\alpha_{11}$, $\alpha_{12}$) are asymmetrically adjusted according to the following equations:

$$\alpha_{11,new} = \frac{\gamma_{new}}{2} - \delta_1;$$

$$\alpha_{12,new} = \frac{\gamma_{new}}{2} + \delta_1.$$

where $\delta_1$ is the correction angle.

6. The folding former of claim 4, wherein the correction angle $\delta_1$ is at most 2°.

7. The folding former of claim 6, wherein the correction angle $\delta_1$ is at most 1°.

8. The folding former of claim 2, wherein the former flank angles ($\alpha_{11}$, $\alpha_{12}$) are adjusted symmetrically by a correction angle $\delta_2$ to reduce web tensions.

9. The folding former of claim 8, wherein the former flank angles ($\alpha_{11}$, $\alpha_{12}$) are adjusted according to the following equation:

$$\alpha_{11,new} = \alpha_{12,new} = \frac{\gamma_{new}}{2} + \delta_2.$$

where $\delta_2$ is a correction angle used to reduce web tensions.

10. The folding former of claim 8, wherein the correction angle $\delta_2$ lies in a range of −1° to +1°.

11. The folding former of claim 10, wherein the correction angle $\delta_2$ lies in a range between −0.5° and +0.520.

12. The folding former of claim 1, wherein said pivot point or a pivot axis is arranged along a top end of said folding former.

* * * * *